United States Patent [19]

Foslien

[11] 4,240,280

[45] Dec. 23, 1980

[54] HAND CRIMPING TOOL

[75] Inventor: Floyd L. Foslien, Stillwater, Minn.

[73] Assignee: Minnesota Mining and Manufacturing Company, Saint Paul, Minn.

[21] Appl. No.: 10,372

[22] Filed: Feb. 8, 1979

[51] Int. Cl.[3] ..... B21D 7/06

[52] U.S. Cl. ..... 72/410; 29/243.56; 72/451; 81/318

[58] Field of Search ..... 72/410, 409, 451, 412; 81/318, 319, 320, 321, 322, 323, 324, 325, 326, 327, 328; 29/243.56

[56] References Cited

U.S. PATENT DOCUMENTS

| | | | |
|---|---|---|---|
| 3,029,670 | 4/1962 | Over | 81/363 |
| 3,630,068 | 5/1970 | Floyd | 72/410 |
| 3,837,211 | 9/1974 | Gress | 72/410 |
| 3,888,105 | 6/1975 | Bert | 72/410 |
| 3,945,705 | 3/1976 | Seim | 339/98 |

FOREIGN PATENT DOCUMENTS

| | | | |
|---|---|---|---|
| 1298930 | 6/1962 | France | 72/410 |

*Primary Examiner*—Francis S. Husar
*Assistant Examiner*—Gene P. Crosby
*Attorney, Agent, or Firm*—Cruzan Alexander; Donald M. Sell; Terryl K. Qualey

[57] ABSTRACT

A hand crimping tool having a first handle and a second handle connected to the first handle by a main pivot pin and a pair of jaws connected to the handles for movement together upon pivoting of the handles about the main pivot pin. A signal mechanism is provided to produce a sensory perception to the user of the completion of a predetermined crimping movement of the jaws.

7 Claims, 4 Drawing Figures

HAND CRIMPING TOOL

FIELD OF THE INVENTION

The present invention relates to a hand crimping tool with means to indicate when a predetermined crimping motion has been completed.

BACKGROUND OF THE INVENTION

Hand crimping tools are used extensively in forcing the parts of insulated solderless electrical connectors, such as that disclosed in U.S. Pat. No. 3,945,705, together to make simultaneous electrical connection to a multiplicity of electrical wires. Crimping tools for such connectors are generally made with parallel acting jaws so as to uniformly apply pressure to the top and bottom of the connector. If the crimping motion is not fully completed by the tool operator the electrical connections to the wires will be substandard and some of the connections may even not be completed. For this reason prior art tools have provided ratchet mechanisms which, once the crimping motion is started, do not permit the jaws to return to their original positions until a predetermined crimping motion has been completed. Such tools have suffered from two problems. First, as a user becomes experienced with the tool he constantly applies excessive pressure to be assured the crimping will be completed so that he does not have to make a second crimping motion. In doing so tool breakage can occur. Second, once the crimping motion is started it must be completed even though the operator notices a wire is missing or that he has improperly positioned the connector in the tool.

SUMMARY OF THE INVENTION

The hand crimping tool of the present invention has a first handle and a second handle connected to the first handle by a main pivot pin with a first jaw and a second jaw connected to the handles for movement together upon pivoting of the handles about the main pivot pin. A lever is pivoted on the second handle, the lever being connected to the second jaw to cause the second jaw to urge the lever to pivot when force is applied to the second jaw. A latch member is pivoted on a latch pivot pin attached to the second handle, the latch member being formed to engage the lever to retain the lever against the pivoting force applied by the second jaw. A latch pivot spring is positioned to urge the latch to pivot to engage the lever, and a latching spring is positioned to urge the lever to pivot to move the lever into position for engagement by the latch member. A trip abutment is provided on a first handle in position to contact the latch member and cause the latch member to pivot to disengage the latch member from the lever when the handles have traveled a distance sufficient to move the jaws through a predetermined crimping movement, and a signal abutment is positioned on the second handle aligned with and spaced from the lever when it is engaged by the latch member to be struck by the lever when it is released by the latch member to provide sensory perception to the user of the completion of the predetermined crimping movement.

With the hand crimping tool of the present invention the sensory perception provided to the user allows him to make a proper crimping movement each time without applying excessive crimping force.

THE DRAWING

Figure 1:
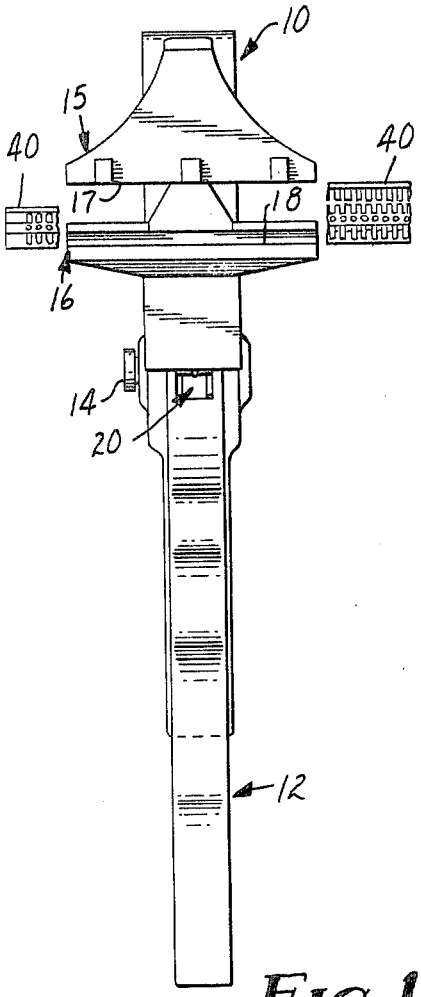
FIG. 1 is a front elevation view of a hand crimping tool constructed in accordance with the present invention with a portion of an uncrimped connector to the right of the tool and a portion of a fully crimped connector to the left of the tool.

The tool has a first or upper handle 10 and a second or lower handle 12 connected to the first handle 10 by a main pivot pin 14. A first or upper jaw 15 is provided as a normally stationary part of the first handle 10 and a second or lower jaw 16 is slidable in the first handle 10 toward the upper jaw 15 to at all times maintain its crimping surface 18 parallel to the crimping surface 17 of the first jaw 15.

An L-shaped lever 20 is pivoted at the juncture of its legs on a lever pivot pin, which in the illustrated embodiment is the main pivot pin 14, on the second handle 12. One leg 21 of the lever 20 is connected to the second or lower jaw 16 by a short connecting link 24.

The connecting link is connected at one end to the second jaw 16 by first pivot pin 25 and at its opposite end to the one leg 21 of the lever 20 by a second pivot pin 26. The axes of the main pivot pin 14, the first pivot pin 25 and the second pivot pin 26 are in parallel. A plane passing through the main pivot pin 14 and the first pivot pin 25 intersect the crimping surfaces 17 and 18 of the jaws 15 and 16 perpendicularly and generally through the centerlines thereof. The axis of the second pivot pin 26 at all times in the crimping movement lies to the right of the plane through the main pivot pin 14 and first pivot pin 25, as viewed in the drawings.

When the handles 10 and 12 are moved together about main pivot pin 14, the first leg 21 of lever 20 transmits force through connecting link 24 to raise the second or lower jaw 16. If a connector is between the jaws 15 and 16 it will resist movement of the second jaw 16 and thus cause force to be transmitted from the second jaw through the connecting link 24 to the lever 20. This force urges the lever to pivot clockwise about main pivot pin 14. A handle opening spring 27 is connected between the handles 10 and 12 forward of the main pivot pin 14 to pivot the handles to the open position, illustrated in FIG. 2, when the handles are released.

An L-shaped latch member 28 is pivoted at the junction of its legs on a latch pivot pin 29 attached to the second handle 12 at the end of the second leg 22 of the L-shaped lever 20. One leg 30 of the latch member 28 extends over the second leg 22 of the lever 20 and the second leg 31 of the latch member 28 extends around and is formed with a shoulder 32 to engage the free end of the second leg 22 of the lever 20 to retain the lever against any clockwise pivoting force applied by the second jaw 16.

A latch pivot compression spring 34 is positioned between the one leg 30 of the latch member 28 and the second leg 22 of the lever 20 to urge the latch 28 to pivot to engage the shoulder 32 on the second leg 31 of the latch 28 with the end of the second leg 22 of the lever 20. A latching compression spring 35 is positioned between the second handle 12 and the side of the second leg 22 of the lever 20 opposite the latch pivot spring 34 to urge the lever 20 to pivot counterclockwise to urge the second leg 22 of the lever 20 into position for engagement by the shoulder 32 on the second leg 31 of the latch member 28.

A trip abutment pin 37 is provided on the first handle 10 in position to contact the one leg 30 of the latch member 28 and cause the latch member to pivot counterclockwise to disengage the shoulder 32 on the second leg 31 from the second leg 22 of the lever 20 when the handles 10 and 12 have traveled a distance sufficient to move the jaws 15 and 16 through a predetermined crimping movement. A signal abutment pin 38 is provided on the second handle 12 aligned with and spaced below the second leg 22 of the lever 20 when it is engaged by the latch member 28 to be struck by the second leg 22 of the lever 20 when it is released from the shoulder 32 of the latch member 28. The striking of the second leg 22 against the signal pin 38 provides a sensory perception to the user of the completion of the predetermined crimping movement. In the illustrated tool the sensory perception is both auditory and tactile.

Figure 3:
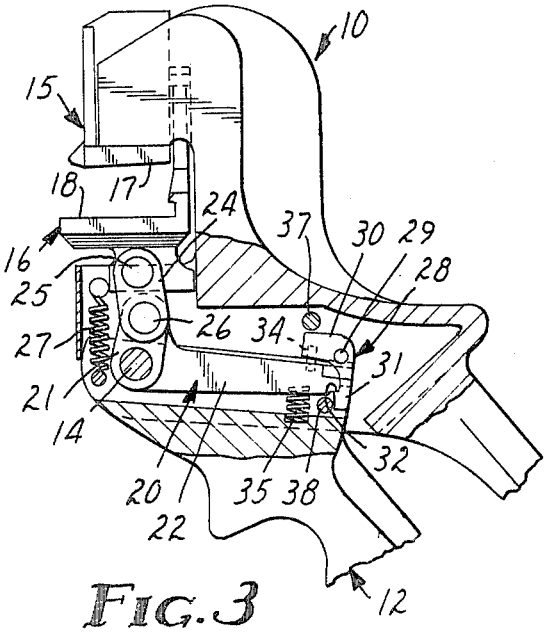
FIG. 3 is a side elevation view of a portion of the tool with the jaws nearing completion of the crimping motion.
Figure 4:
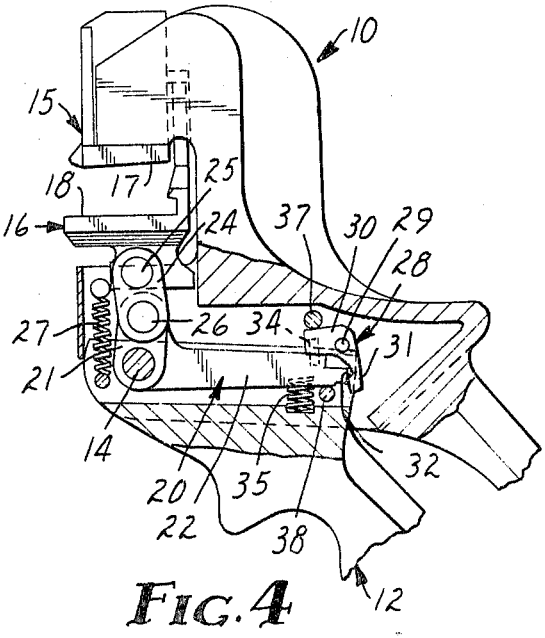
FIG. 4 is a side elevation view like that of FIG. 3 with the jaws having completed the crimping motion and the crimping signal having activated.

In use, a connector 40, such as that illustrated in U.S. Pat. No. 3,945,705, is stacked up with the wires in proper position as illustrated in part to the right of the jaws of the tool in FIG. 1. The stacked connector is inserted between the jaws 15 and 16 and the user then grasps the handles 10 and 12 and squeezes them together. Movement of the handles together causes the L-shaped lever 20 to pivot about the main pivot pin 14 and through the connecting link 24 to raise the second or lower jaw 16 toward the upper jaw 15 to crimp the connector 40. As the jaw 16 approaches the completion of its travel, as illustrated in FIG. 3, the leg 30 of the latch member 28 on the second or lower handle 12 rises into contact with the trip pin 37 on the first or upper handle 10. Continued movement of the handles and jaws to completion of the crimping movement as illustrated in FIG. 4 causes the trip pin 37 to pivot the latch member 28 to release the shoulder 32 from the second leg 22 of the lever 20. The force on the lower jaw 16 exerted on the lever 20 through the connecting link 24 forcefully pivots the lever 20 clockwise causing the second leg 22 of the lever 20 to strike the signal pin 38 which provides a auditory and tactile signal to the user that the predetermined crimping movement has been completed. A portion of the completely crimped connector 40 is illustrated to the left of the jaws 15 and 16 in FIG. 1.

Figure 2:
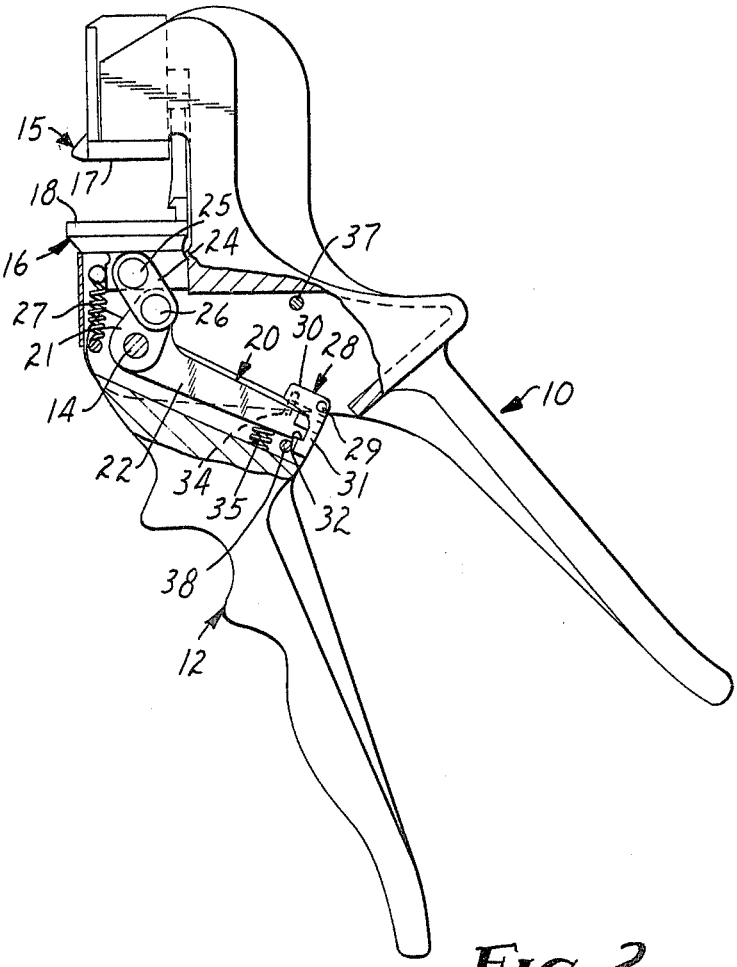
FIG. 2 is a side elevation view, partially in section, of the tool of FIG. 1 with the jaws in the fully open position.

When the user releases the force on the handles 10 and 12, the handle opening spring 27 causes the handles to pivot apart toward their open position illustrated in FIG. 2. The force is then removed from the second or lower jaw 16 and the leg 30 of the latch member 28 moves away from the trip pin 37 so that the latching spring 35 can pivot the lever 20 counterclockwise while the latch pivot spring 34 pivots the latch member 28 clockwise to reengage the shoulder 32 on the second leg 31 of the latch member 28 with the end of the second leg 22 of the lever 20 to reset the crimping signal mechanism.

I claim:

1. A hand crimping tool comprising:

a first handle, a second handle connected to said first handle by a main pivot pin, a first jaw and a second jaw connected to said handles for movement together upon pivoting of said handles about said main pivot pin, a lever pivoted on said second handle, said lever being connected to said second jaw to cause said second jaw to urge said lever to pivot when force is applied to said second jaw, a latch member pivoted on a latch pivot pin attached to said second handle, said latch member being formed to engage said lever to retain said lever against the pivoting force applied by said second jaw, a latch pivot spring urging said latch to pivot to engage said lever, a latching spring urging said lever to pivot to urge said lever into position for engagement by said latch member, a trip abutment on said first handle in position to contact said latch member and cause said latch member to pivot to disengage said latch from said lever when said handles have traveled a distance sufficient to move said jaws through a predetermined crimping movement, and a signal abutment on said second handle aligned with and spaced from said lever when it is engaged by said latch member to be struck by said lever when it is released from said latch member to provide sensory perception to the user of the completion of the predetermined crimping movement.

2. The crimping tool of claim 1 wherein said lever is pivoted on said main pivot pin.

3. The crimping tool of claim 1 wherein said first jaw and said second jaw are on said first handle and have parallel crimping surfaces and said second jaw is nearest said second handle and is slidable in said first handle toward said first jaw.

4. The crimping tool of claim 1 wherein said lever is L-shaped and is pivoted at the juncture of its legs, and said lever is connected to said second jaw by one of its legs; wherein said latch member is L-shaped and is pivoted at the juncture of its legs at the end of the second leg of said L-shaped lever, one leg of said latch member extending over said second leg of said lever and the second leg of said latch member extending around and being forward to engage the free end of said second leg of said lever.

5. The crimping tool of claim 4 wherein said latch pivot spring is positioned between said one leg of said latch member and said second leg of said lever and said latching spring is positioned between said second handle and the side of said second leg of said lever opposite said latch pivot spring.

6. The crimping tool of claim 4 wherein said first jaw and said second jaw are on said first handle and have parallel crimping surfaces and said second jaw is nearest said second handle and is slidable in said first handle toward said first jaw.

7. The crimping tool of claim 6 wherein said lever is pivoted on said main pivot pin, and including a connecting link connected at one end to said second jaw by a first pivot pin and at its opposite end to said one leg of said lever by a second pivot pin the axes of said main pivot pin and said first pivot pin being parallel and lying in a plane perpendicular to said crimping surfaces of said jaws and generally through the centerlines thereof.

* * * * *